US008701758B2

(12) United States Patent
Dowsett et al.

(10) Patent No.: US 8,701,758 B2
(45) Date of Patent: Apr. 22, 2014

(54) WELL SCREEN

(75) Inventors: Graeme John Dowsett, Singapore (SG); Anush Rajaram, Singapore (SG); Michael Hill Fung Cheung, Singapore (SG); Eddie Hiong Wee Yap, Singapore (SH); Meng Yeow Gan, Singapore (SG)

(73) Assignee: Completion Products Pte Ltd, Singapore (SG)

( * ) Notice: Subject to any disclaimer, the term of this patent is extended or adjusted under 35 U.S.C. 154(b) by 202 days.

(21) Appl. No.: 12/919,646

(22) PCT Filed: Feb. 25, 2009

(86) PCT No.: PCT/SG2009/000067

§ 371 (c)(1),
(2), (4) Date: Aug. 26, 2010

(87) PCT Pub. No.: WO2009/108128

PCT Pub. Date: Sep. 3, 2009

(65) Prior Publication Data

US 2010/0319914 A1 Dec. 23, 2010

(30) Foreign Application Priority Data

Feb. 27, 2008 (SG) ..... 200801718-8

(51) Int. Cl.
*E21B 43/08* (2006.01)
*E03B 3/20* (2006.01)

(52) U.S. Cl.
USPC ..... 166/231; 166/230; 166/236

(58) Field of Classification Search
USPC ..... 166/278, 227, 230, 231, 236
See application file for complete search history.

(56) References Cited

U.S. PATENT DOCUMENTS

| | | | | |
|---|---|---|---|---|
| 1,342,986 | A * | 6/1920 | Cater | 166/230 |
| 2,217,370 | A * | 10/1940 | Johnston | 166/230 |
| 5,909,773 | A * | 6/1999 | Koehler et al. | 166/277 |
| 5,992,518 | A * | 11/1999 | Whitlock | 166/235 |
| 6,382,318 | B1 * | 5/2002 | Whitlock | 166/278 |
| 6,607,032 | B2 * | 8/2003 | Voll et al. | 166/227 |
| 6,805,202 | B2 * | 10/2004 | Gillespie et al. | 166/378 |
| 7,287,684 | B2 * | 10/2007 | Blackburne, Jr. | 228/130 |
| 7,497,257 | B2 * | 3/2009 | Hopkins et al. | 166/278 |
| 8,176,634 | B2 * | 5/2012 | Bonner et al. | 29/896.62 |
| 2007/0199889 | A1 * | 8/2007 | Tueshaus et al. | 210/497.01 |
| 2007/0256834 | A1 * | 11/2007 | Hopkins et al. | 166/278 |
| 2010/0319914 | A1 * | 12/2010 | Dowsett et al. | 166/276 |

FOREIGN PATENT DOCUMENTS

| | | | |
|---|---|---|---|
| WO | WO 02/23009 | A2 | 3/2002 |
| WO | WO 02/057594 | A1 | 7/2002 |
| WO | WO 2004/111384 | A1 | 12/2004 |

OTHER PUBLICATIONS

International Search Report and Written Opinion for International Appl. No. PCT/SG2009/000067 dated Jun. 5, 2009.

* cited by examiner

*Primary Examiner* — Jennifer H Gay
(74) *Attorney, Agent, or Firm* — Alston & Bird LLP

(57) ABSTRACT

A well screen (101) having a base pipe (103), a filter layer (105) arranged around the base pipe (103), and a discrete mesh outer standoff layer (107) arranged around the filter layer (105) in a first spiral wrap (109) is provided. The first spiral wrap (109) comprises a first succession of loops such that a trailing edge of a next one of the first succession of loops is in contact, or in overlap, with a leading edge of a previous one of the first succession of loops; and to produce a compressive force on the filter layer (105) radially towards the base pipe (103).

9 Claims, 6 Drawing Sheets

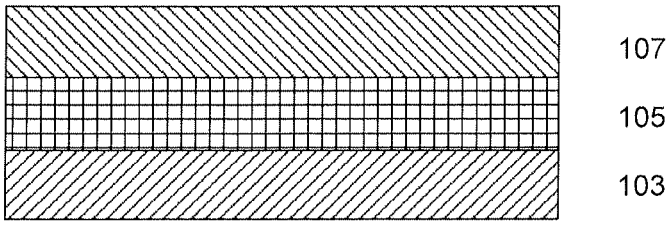
Figure 2
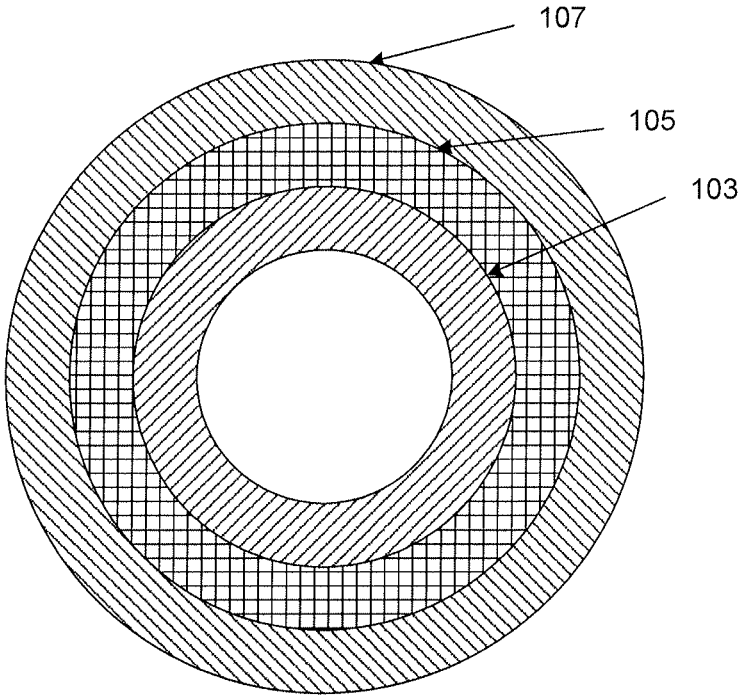
Figure 3 – Section I-I of Figure 1

WELL SCREEN

CROSS REFERENCE TO RELATED APPLICATIONS

This application is a national stage application filed under 35 U.S.C. 371 of International Application No. PCT/SG2009/000067, filed Feb. 25, 2009, which claims priority from Singapore Application No. 200801718-8, filed Feb. 27, 2008, each of which is incorporated herein by reference in its entirety.

FIELD OF THE INVENTION

The present invention relates to a well screen and a method of forming a well screen. The invention has particular, but not exclusive, application in the use of extraction of well fluids such as oil, gas or water.

BACKGROUND OF THE INVENTION

Well screens are generally used in subterranean wells in which it is desirable to extract well fluids such as oil, gas or water from the ground without bringing the debris, for example sand and other soil particulates, up with the fluid.

Conventionally, a well screen includes a length of perforated pipe known as a base pipe, one end of which is connected to a transportation pipe to transport the extracted fluid to the surface of the earth. A filter medium is disposed around the base pipe to prevent the debris in the fluid from entering the base pipe. A protective cover is further disposed around the filter layer to protect the filter medium from abrasion and impact while it is being run into a well bore. There is therefore a clearance (or gap) between the filter medium and the base pipe and/or between the filter medium and the protective cover to facilitate the assembly of the respective components of the well screen.

SUMMARY OF THE INVENTION

The invention is defined in the independent claims. Some optional features of the invention are defined in the dependent claims.

By providing an outer standoff layer in a spiral wrap in accordance with one or more of the techniques described below, clearances between the filter layer and the discrete mesh outer standoff layer and/or between the filter layer and the base pipe may be reduced or even removed. This is because a compressive force is produced on the filter layer radially towards the base pipe. This may provide greater mechanical strength/rigidity than hitherto available from known well screens and the discrete mesh outer standoff layer may provide the filter layer with higher burst strength and/or increased resistance to collapse in circumstances of excessive well pressures when in situ during fluid extraction and/or during pumping of well completion fluids. Additionally, the filter layer (which is often made up from multiple layers) can be reduced either in thickness or in mechanical strength of material due to the additional support provide by the outer standoff layer and the compressive force. Thus, cost of the elements of the well screen—particularly the filter media—can be reduced.

Additionally, the orientation of the outer standoff layer provides increased mechanical support under bursting conditions in the well screen, typically the most difficult mechanical property of the well screen to achieve.

For example, a discrete mesh inner standoff layer may be arranged around the base pipe in a spiral wrap to space the filter layer from the base pipe. The arrangement may be such that the discrete mesh inner standoff layer is in contact with the base pipe. Because clearances between the base pipe and the discrete mesh inner standoff layer may be removed, support may be provided to the filter layer to minimise collapse of the same.

BRIEF DESCRIPTION OF THE DRAWINGS

Embodiments of the invention will now be described by way of example only and with reference to the accompanying drawings, of which:

FIG. 2 is a sectional view illustrating a longitudinal, cross-sectional view of the well screen of FIG. 1;

FIG. 3 is a sectional view illustrating a cross-sectional view I-I of the well screen of FIG. 1.

DETAILED DESCRIPTION OF THE EMBODIMENTS

Figure 1:
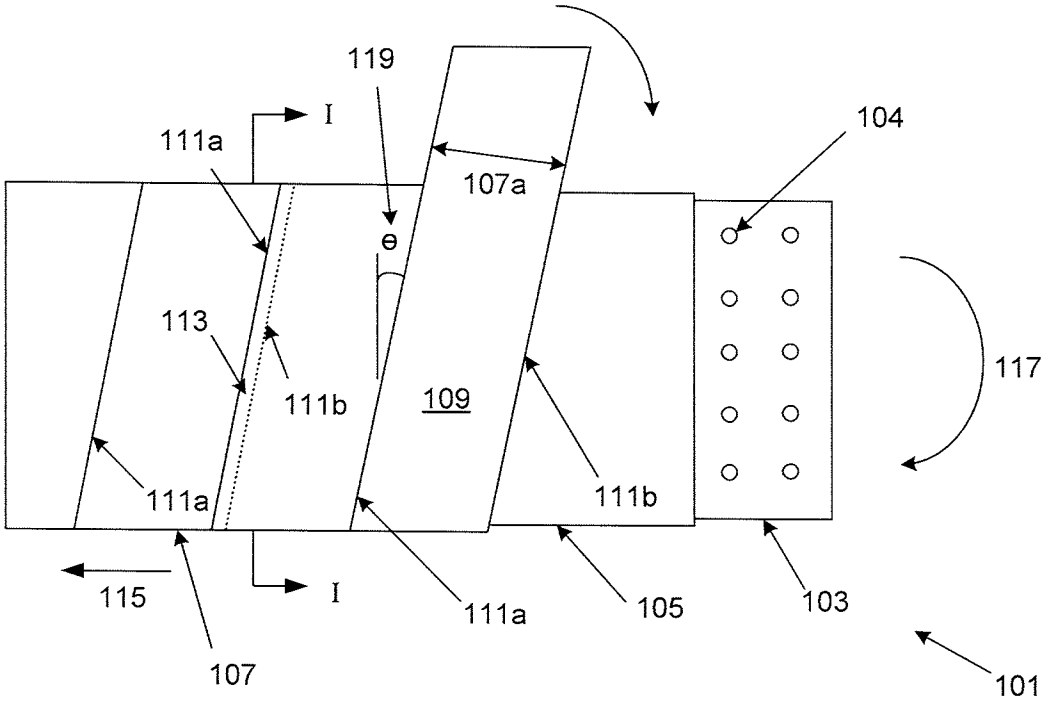
FIG. 1 is a layout diagram illustrating a discrete mesh outer standoff layer being spirally wrapped around a filter layer during the construction of a first embodiment of the well screen.

FIG. 1 is a layout diagram illustrating a first well screen. As shown, a portion of a well screen assembly 101 has a base pipe 103 having perforations 104, a filter layer 105 arranged around the base pipe 103, and a discrete mesh outer standoff layer 107 of width 107*a* arranged around the filter layer 105 in a spiral wrap 109. In FIG. 1, the detail of the mesh is not shown for the sake of clarity. However, the mesh of outer standoff layer 107 can be, for example, a welded mesh or a woven mesh, as long as there is a flow path for flow of fluid from outside outer standoff layer 107, through filter layer 105 and through perforations 104 of base pipe 103. The spiral wrap 109 of outer standoff layer 107 comprises a succession of loops (in this example, each loop being defined by a 360-degree revolution in the direction 117 around the circumference of the base pipe 103, offset by angle θ 119 from a direction normal to the longitudinal axis of the well screen 101). A trailing edge 111*a* of a next one of the succession of loops is in contact, or in overlap 113, with a leading edge 111*b* of a previous one of the succession of loops. That is, the edges of successive loops of the spiral wrap 109 touch one another so that they are "flush" presenting a substantially uniform surface height on the filter layer 105 or touch in overlap—preferably a slight overlap 113—with one another. In addition, the spiral wrap 109 produces a compression force on the filter layer 105 in a direction radially towards the base pipe 103.

In one construction, the discrete mesh outer standoff layer 107 is wrapped tight around the filter layer 105 such that any clearance (or gap) between the discrete mesh outer standoff layer 107 and the filter layer 105, or between the filter layer 105 and the base pipe 103, is minimised or reduced, and preferably removed.

Note that the term succession of loops is not to be understood to be limited to a plurality of complete loops (i.e. revolutions) around the base filter layer 105. The inventors have found that it may be sufficient to provide only a single complete loop and a partial further loop. Depending on the width of the band of the filter layer in the longitudinal direction 115 and the width 107*a* of outer standoff layer 107, it may be sufficient to provide only a partial second loop to cover the filter layer 105. Thus, a trailing edge 111*a* of the partial second loop of the succession of loops my be disposed in contact or in overlap with a leading edge 111*b* of the first loop.

Figure 4:
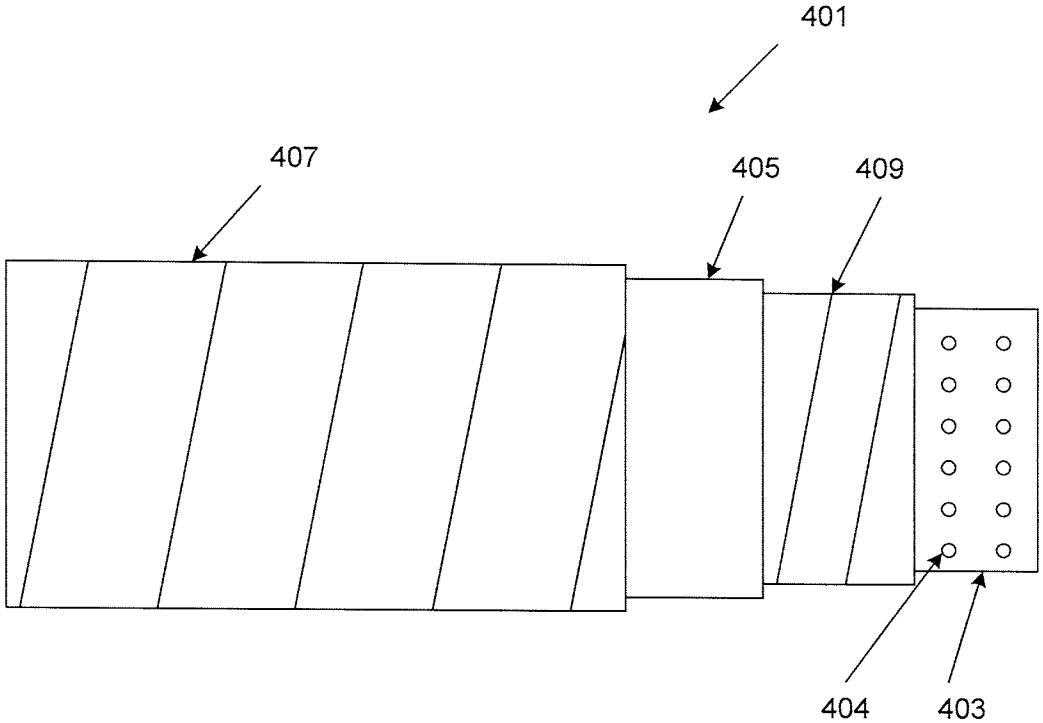
FIG. 4 is a layout diagram illustrating of the well screen according to a second embodiment.
Figure 8:
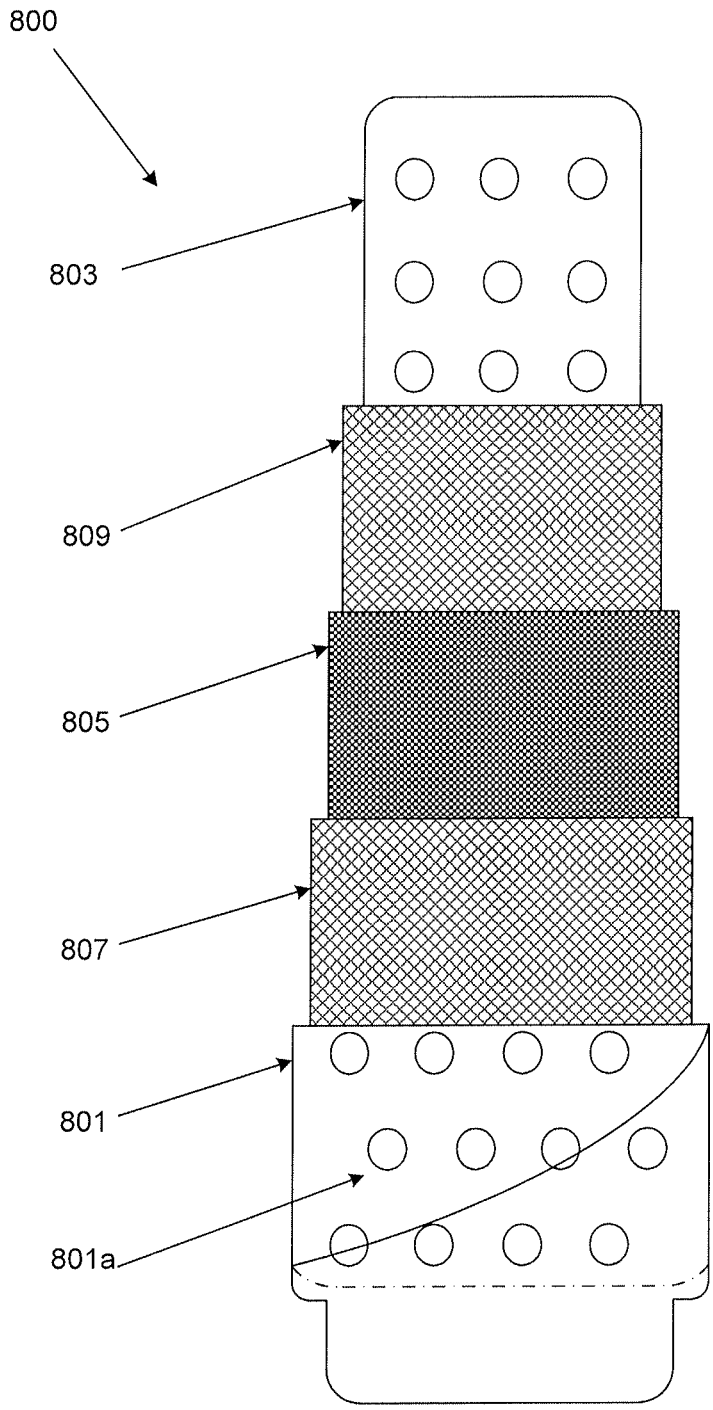
FIG. 8 is a layout diagram illustrating the well screen of FIG. 4 additionally having a protective cover.

Similar considerations apply to the making up of the inner standoff layers 409, 809 of, say, FIGS. 4 and 8.

Thus, reduction of clearances between layers provides enhanced rigidity and, in effect, the discrete mesh outer standoff layer 107 provides support to the filter layer 105 to counter hoop stresses—i.e. outward radial pressure exerted from the base pipe 103 to the discrete mesh outer standoff layer 107—generated during fluid extraction, whereby the filter layer 105 may be deformed. If the filter layer 105 were to be stretched beyond its maximum elongation, it will consequently be damaged. Accordingly, the minimisation of any clearance between the filter layer 105 and the discrete mesh outer standoff layer 107 means that the filter layer 105 may have higher burst hoop strength to overcome the possible hoop stresses during fluid extraction and/or pumping of well completion fluids.

In one construction of the well screen 101, opposite edges of a planar piece of the filter layer 105 are connected to each other by, for example welding, before the filter layer 105 slides over the base pipe 103. Accordingly, the welding quality of the filter layer 105 may be inspected before it is arranged around the base pipe 103. The combination of the base pipe 103 and the filter layer 105 is then fed into a spiral mill (not shown) in the direction of arrow 115 and is rotated in the direction of arrow 117 about the longitudinal axis of the well screen 101. As the well screen 101 enters into the spiral mill, the discrete mesh outer standoff layer 107 is wrapped onto the filter layer 105 at angle θ 119 from a direction normal to the longitudinal axis of the well screen 101. Suitable ranges of angles for θ 119 are between 10 and 40, or 20 and 30 degrees. Accordingly, the discrete mesh outer standoff layer 107 is arranged on the filter layer 109 in the form of a continuous spiral wrap. The relationship between the linear and angular velocities in directions 115, 117 respectively of the well screen can be selected as appropriate to provide a suitable angle at which the outer standoff layer 109 is arranged on the filter layer 105. Additionally, the width of the outer standoff layer 109 such that it is wrapped "flush" (i.e. flat on the filter layer, an edge of one loop of the wrap touches an edge of the adjacent loop) or in overlap, is selected appropriately. The inventors have found that the smaller the width 107*a* of the outer standoff layer (i.e. the narrower the band of the wrap) and the smaller the angle θ 119, the greater the hoop strength (discussed below) will be.

In one construction, outer standoff layer 107 covers filter layer 105 completely, thus enhancing mechanical strength and limiting the possibility of damage to the filter layer 105.

FIG. 2 is a sectional view illustrating a longitudinal, cross-section of layers 103, 105, 107 of the well screen 101. In this example, because the discrete mesh outer standoff layer 107 is wrapped tight around the filter layer 105, it is seen that there is no clearance (i.e. gaps) between these layers 105, 107 over a substantial length of the well screen 101.

FIG. 3 is a sectional view illustrating a cross-section I-I of the well screen 101. Because the discrete mesh outer standoff layer 107 is wrapped tight around the filter layer 105, it is again seen that there is no cross-sectional clearance (gaps) between these layers 105, 107.

FIG. 4 is a layout diagram of a second well screen illustrating a portion of a well screen 401 having a base pipe 403 with perforations 404, a filter layer 405 arranged around the base pipe 403, and a discrete mesh outer standoff layer 407 arranged around the filter layer 405. In this respect, the well screen 401 of this embodiment is similar to the well screen 101 of the previous embodiment, as described above.

In this embodiment, however, the well screen 401 additionally comprises a discrete mesh inner standoff layer 409 arranged around the base pipe 403, which spaces the filter layer 405 from the base pipe 403. Thus, the discrete mesh inner standoff layer 409 may provide support to the filter layer 405, thereby minimising collapse of the filter layer 405 during fluid extraction. If the filter layer 405 were stretched beyond its maximum elongation due to possible collapse, it will consequently be damaged.

Inner standoff layer 409 also enhances flow properties by spacing the high open area filter layer from the lower open area base pipe. This spacing allows for more uniform flow through the filter layer rather than directly over base pipe perforations.

Figure 5:
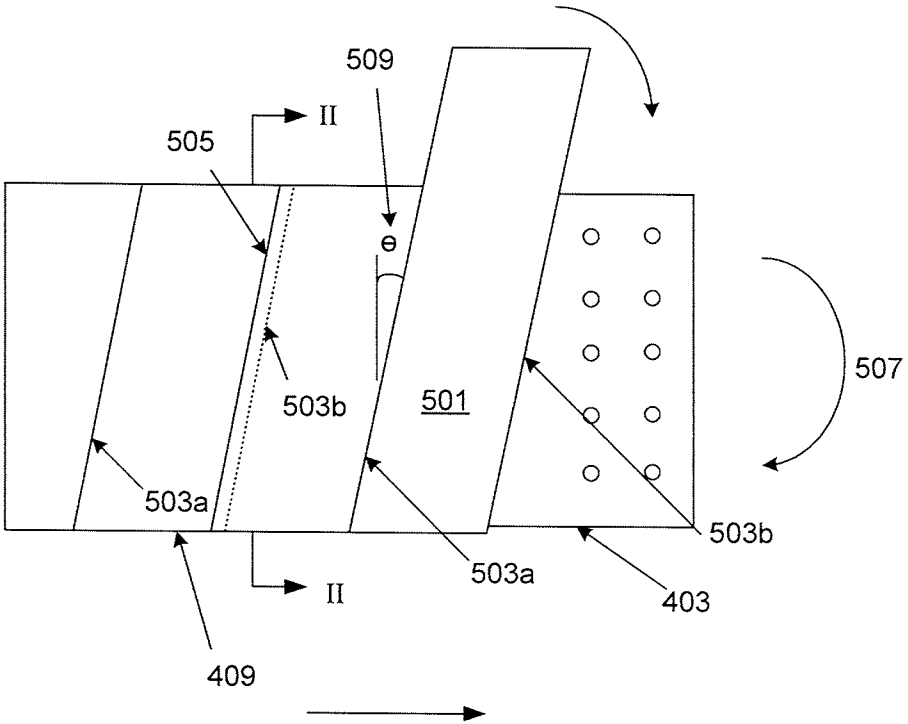
FIG. 5 is a layout diagram illustrating the discrete mesh inner standoff layer being spirally wrapped around the base pipe during the construction of the well screen of FIG. 4.

FIG. 5 is a layout diagram illustrating the discrete mesh inner standoff layer 409 being spirally wrapped around the base pipe 403. Like the discrete mesh outer standoff layer 107 previously described, the discrete mesh inner standoff layer 409 is arranged around the base pipe 403 in a spiral wrap 501 (in this example, each loop being defined by a 360-degree revolution in the direction 507 around the circumference of the base pipe 403, offset by angle θ 509 from a direction normal to the longitudinal axis of the well screen 101). A trailing edge 503*a* of a next one of the succession of loops is also in contact, or in overlap 505, with a leading edge 503*b* of a previous one of the succession of loops. That is, the edges of successive loops of the spiral wrap 501 touch one another so that they are "flush" presenting a substantially uniform surface height on the filter layer base pipe 403 or touch in overlap—preferably a slight overlap 505—with one another. Additionally, the discrete mesh inner standoff layer 409 contacts the base pipe 403.

Figure 6:
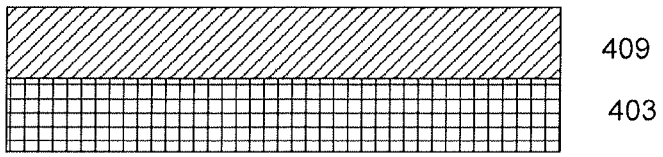
FIG. 6 is a sectional view illustrating a longitudinal, cross-sectional view of the well screen of FIG. 4.

FIG. 6 is a sectional view illustrating a longitudinal, cross-section of the well screen 401. Because the discrete mesh inner standoff layer 409 is in contact with the base pipe 403, it is seen that there is no longitudinal clearance between the discrete mesh inner standoff layer 409 and the base pipe 403 over a substantial length of the well screen 401.

Figure 7:
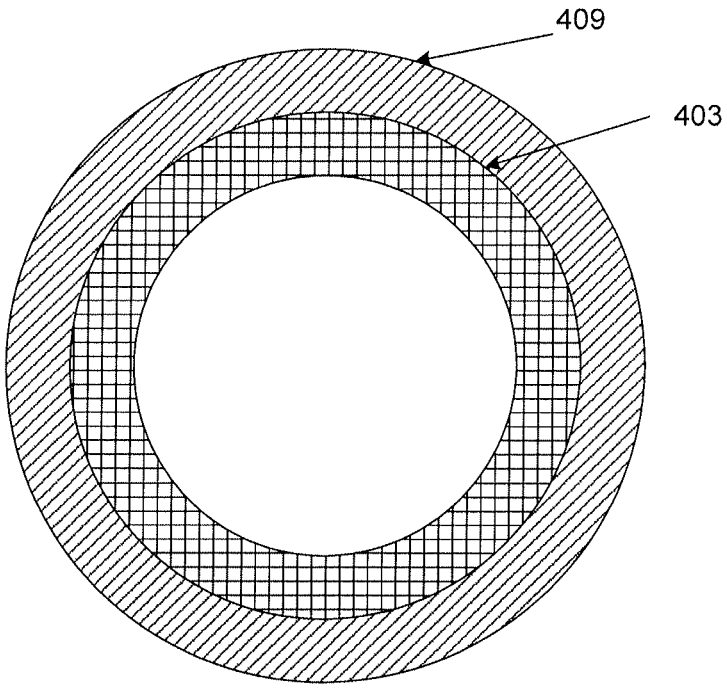
FIG. 7 is a sectional view illustrating a cross-sectional view II-II of the well screen of FIG. 4.

FIG. 7 is a sectional view illustrating a cross-section II-II of the well screen 401. Because the discrete mesh inner standoff layer 409 is in contact with the base pipe 403, it is again seen that there is no cross-sectional clearance between the discrete mesh inner standoff layer 409 and the base pipe 403.

In one method of constructing the well screen 401, the discrete mesh inner standoff layer 409 may be introduced onto the base pipe 403 using the spiral mill, as previously mentioned. Thereafter, the filter layer 405 slides onto the discrete mesh inner standoff layer 409, after it has been welded along its longitudinal edges. The discrete mesh outer standoff layer 407 is then spirally wrapped around the filter layer 405 in the same way as previously described.

Because the discrete mesh outer standoff layer 407 is spirally wrapped tight around the filter layer 405 such that a compressive force is produced in a direction radially towards the base pipe 403, any clearance between the discrete mesh outer standoff layer 407 and the filter layer 405, between the filter layer 405 and the inner standoff layer 409, or between the inner standoff layer 409 and the base pipe 403 is minimised/reduced or removed. Accordingly, the filter layer 405 may be provided with not only a higher hoop strength, but also greater resistance to collapse during fluid extraction.

FIG. 8 is a layout diagram illustrating a third well screen 800, additionally comprising a protective shroud (or cover 801) spirally welded over outer standoff layer 807. Shroud 801 has perforations 801*a* to allow fluid flow in an inwards radial direction towards the base pipe. In this well screen, base pipe 803, inner standoff layer 809, filter layer 805 and outer standoff layer 807 are made up as discussed above with respect to FIGS. 1 to 7, where inner standoff layer 809 is wrapped tight against base pipe 806 and outer standoff layer 807 is wrapped tight over filter layer 805, which has been slid on over inner standoff layer 809. Additionally, protective cover 801 slides over the discrete mesh outer standoff layer 807, and the protective cover 801 is then swaged on the discrete mesh outer standoff layer 807. The swaging process provides a means to compress the protective cover 801 radially on the discrete mesh outer standoff layer 807. The swaging process may be effected so that the protective cover 801 is compressed on the discrete mesh outer standoff layer 807 in a uniform manner, which maintains the cross-section shape of the protective cover 801 but reduces its diameter. This reduction in the diameter of the protective cover 801 consequentially removes any clearance which previously existed between the discrete mesh outer standoff layer 407 and the protective cover 801.

It should be appreciated that the invention has been described by way of example only and that various modifications in design and/or detail may be made without departing from the spirit and scope of this invention.

The invention claimed is:

1. A well screen comprising:

a base pipe;

a filter layer arranged around the base pipe;

a discrete mesh outer standoff layer arranged around the filter layer in a first spiral wrap comprising a first succession of loops:

said outer standoff layer spirally wrapped around the filter layer at an angle between 10 degrees and 40 degrees;

such that a trailing edge of a next one of the first succession of loops is in contact, or in overlap, with a leading edge of a previous one of the first succession of loops; and to produce a compressive force on the filter layer radially towards the base pipe, wherein the compressive force provides enhanced rigidity to the filter layer.

2. The well screen of claim 1, further comprising a discrete mesh inner standoff layer arranged around the base pipe in a second spiral wrap thereby to space the filter layer from the base pipe.

3. The well screen of claim 2, wherein the second spiral wrap comprises a second succession of loops:

such that a trailing edge of a next one of the second succession of loops is in contact, or in overlap, with a leading edge of a previous one of the second succession of loops; and so that the inner standoff layer is in contact with the base pipe.

4. The well screen of claim 1, further comprising a swaged cover on the discrete mesh outer standoff layer.

5. The method of any of claim 1, further comprising the step of swaging a cover on the discrete mesh outer standoff layer.

6. The well screen of claim 1, wherein the outer standoff layer is wrapped around the filter layer at an angle of between 20 degrees and 30 degrees.

7. A method of forming a well screen, the method comprising the steps of:

arranging a filter layer around a base pipe; and wrapping a discrete mesh outer standoff layer around the filter layer to form a first spiral wrap comprising a first succession of loops:

said outer standoff layer spirally wrapped around the filter layer at an angle between 10 degrees and 40 degrees;

such that a trailing edge of a next one of the first succession of loops is in contact, or in overlap, with a leading edge of a previous one of the first succession of loops; and to produce a compression force on the filter layer radially towards the base pipe, wherein the compression force provides enhanced rigidity to the filter layer.

8. The method of claim 7, further comprising the step of wrapping a discrete mesh inner standoff layer around the base pipe to form a second spiral wrap thereby to space the filter layer from the base pipe.

9. The method of claim 8, wherein the wrapping of the discrete mesh inner standoff layer forms a second succession of loops:

such that a trailing edge of a next one of the second succession of loops is in contact, or in overlap, with a leading edge of the second succession of loops; and so that the inner standoff layer is in contact with the base pipe.

* * * * *